US007334513B2

(12) United States Patent
Belser

(10) Patent No.: US 7,334,513 B2
(45) Date of Patent: Feb. 26, 2008

(54) AXIAL PISTON MACHINE HAVING A FIXABLE SLIDE BLOCK ON THE SWASH PLATE

(75) Inventor: Roland Belser, Haigerloch (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 198 days.

(21) Appl. No.: 10/566,119

(22) PCT Filed: Nov. 12, 2004

(86) PCT No.: PCT/EP2004/012867

§ 371 (c)(1),
(2), (4) Date: Jan. 25, 2006

(87) PCT Pub. No.: WO2005/064159

PCT Pub. Date: Jul. 14, 2005

(65) Prior Publication Data

US 2006/0251526 A1 Nov. 9, 2006

(30) Foreign Application Priority Data

Dec. 22, 2003 (DE) ..... 103 60 452

(51) Int. Cl.
*F04B 1/32* (2006.01)
*F04B 49/00* (2006.01)
*F04B 49/08* (2006.01)

(52) U.S. Cl. ..... 92/12.2; 92/12.1

(58) Field of Classification Search ..... 92/12.1, 92/12.2, 71
See application file for complete search history.

(56) References Cited

U.S. PATENT DOCUMENTS

| | | | | |
|---|---|---|---|---|
| 3,170,450 | A * | 2/1965 | Kent et al. | 92/12.2 |
| 4,379,389 | A | 4/1983 | Liesner | |
| 5,095,807 | A * | 3/1992 | Wagenseil | 92/12.2 |
| 5,295,796 | A * | 3/1994 | Goto et al. | 417/222.1 |
| 5,391,058 | A * | 2/1995 | Goto et al. | 417/223 |
| 5,782,160 | A * | 7/1998 | Boone | 92/12.2 |
| 5,794,515 | A * | 8/1998 | Bethke | 92/12.2 |
| 6,174,139 | B1 * | 1/2001 | Stolzer | 92/12.2 |

FOREIGN PATENT DOCUMENTS

| | | |
|---|---|---|
| DE | 2132252 | 2/1972 |
| DE | 3621 302 A1 | 1/1987 |
| DE | 3627 375 A1 | 2/1988 |
| DE | 39 35 800 A1 | 5/1991 |
| DE | 199 49 169 A1 | 4/2001 |

* cited by examiner

*Primary Examiner*—Thomas E. Lazo
(74) *Attorney, Agent, or Firm*—Scully, Scott, Murphy & Presser, P.C.

(57) ABSTRACT

The invention relates to an axial piston machine having a swash plate (12) and a control piston (18) which contacts the swash plate (12) by way of a slide block (31) which is partially received by the swash plate (12) or the control piston (18). The slide block (31) can be inclined at least in a direction relative to the swash plate (12) or the control piston (18) and can be inserted through an opening into a cutout (80) constructed in the swash plate (12) or the control piston (18), the slide block (31) being fixed in the cutout (80) by fixing regions (83) constructed in the cutout (80). Provided in the swash plate (12) or the control piston (18), there is a resilient element (86, 91) which acts on the slide block (31) with a force directed towards the regions (83) fixing the slide block (31).

7 Claims, 4 Drawing Sheets

AXIAL PISTON MACHINE HAVING A FIXABLE SLIDE BLOCK ON THE SWASH PLATE

Figure 1:
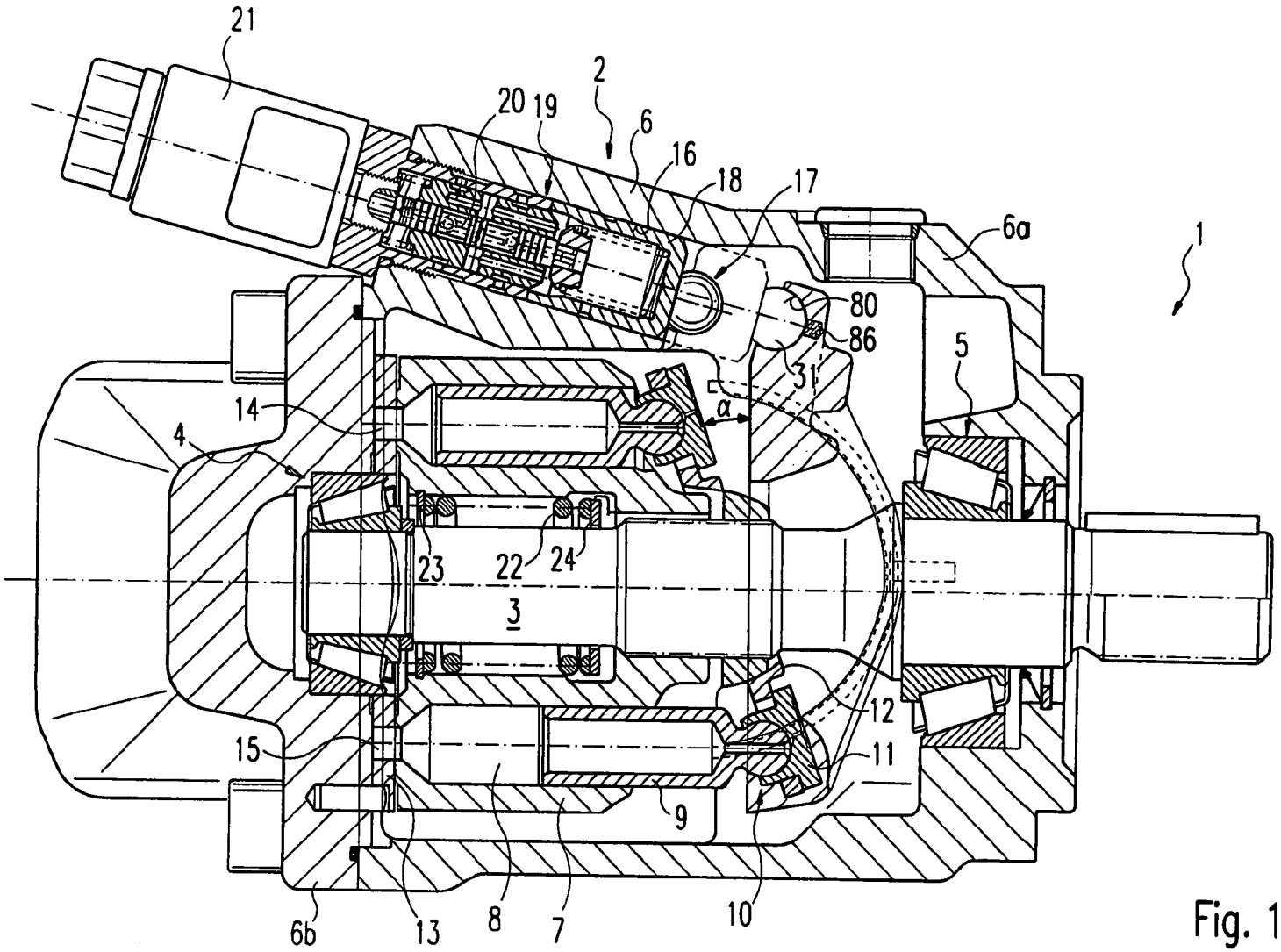

The invention relates to an axial piston machine having a swash plate.

In axial piston machines, it is known to set the angle of inclination of a swash plate relative to the axis of rotation of a cylinder drum by means of an adjusting device. It is known from DE 199 49 169 A1 to insert an adjusting device into a receiving means which is provided for this in the housing of the axial piston machine. Depending on a controlled variable, a control piston of the adjusting device then transmits a force to the rotatably mounted swash plate in an edge region of this latter and thus adjusts the swash plate in terms of its angle of inclination.

In order to convert the linear movement of the control piston into a rotary movement of the swash plate, a dome-shaped cutout, into which a slide block is inserted, is provided in the swash plate. This slide block is constructed to be flat on its side projecting out of the swash plate and is supported with this planar face against the control piston. With a change in the angle of inclination of the swash plate, the slide block is rotated in the dome-shaped cutout. The rotation of the swash plate causes the slide block to execute a lateral movement on the control piston. Therefore, the slide block cannot be fixedly connected to the control piston, but can only abut against the control piston, thereby determining the orientation of the planar face of the slide block relative to the swash plate.

The problem with this is that, when dismantling the adjusting device, e.g. for maintenance purposes or for repair, the position of the slide block or its planar face is no longer defined since the slide block can rotate freely in the spherical cutout. This can mean that the flat side of the slide block no longer comes into contact with the control piston when the adjusting device is reinserted.

The object of the invention, therefore, is to provide an axial piston machine having a swash plate and a slide block, in which the relative position of the slide block is also maintained when the slide block is not in contact with a corresponding face.

The object is achieved by the inventive axial piston machine having the features of Claim 1.

To move the swash plate by means of an adjusting device, the slide block is partially received by the swash plate or a control piston. To this end, the slide block is inserted into a spherical cutout in the swash plate or the control piston. In this cutout, the slide block can be inclined relative to the swash plate and the control piston. The cutout at least partially surrounds the slide block to the extent that it is fixed in the cutout. To this end, regions which surround and fix the slide block are formed at the opening to the cutout. A resilient element is provided to prevent the slide block from rotating when it is not abutting against a corresponding face of the control piston or the swash plate. This resilient element acts on the slide block with a force which presses it against the fixing regions.

This ensures that the slide block cannot rotate unintentionally, even in a state in which the slide block is not held in a particular position by abutting against a corresponding face of the control piston or the swash plate.

To this end, the resilient element presses the slide block against the fixing regions and a friction is generated. This friction depends on the force of the resilient element and can therefore be set such that inadvertent rotation is reliably prevented.

The subclaims relate to advantageous further developments of the axial piston machine according to the invention.

In particular, it is advantageous to arrange the resilient element in a receiving cutout incorporated at the base of the cutout opposite the opening. It is furthermore advantageous here that such a receiving cutout is already required for incorporating the spherical cutout. The inventive solution for preventing the slide block from rotating is thus achieved particularly simply in that a resilient element is selected which can be inserted into the receiving cutout already present.

According to a particularly simple embodiment, the resilient element comprises a spring. In a further embodiment, a spacer which is inserted between the spring and the slide block prevents the end of the spring, which is supported against the slide block, from damaging the slide block mechanically during operation. It is particularly possible here to use a material which, together with the material of the slide block, has a low coefficient of friction.

Figure 2:
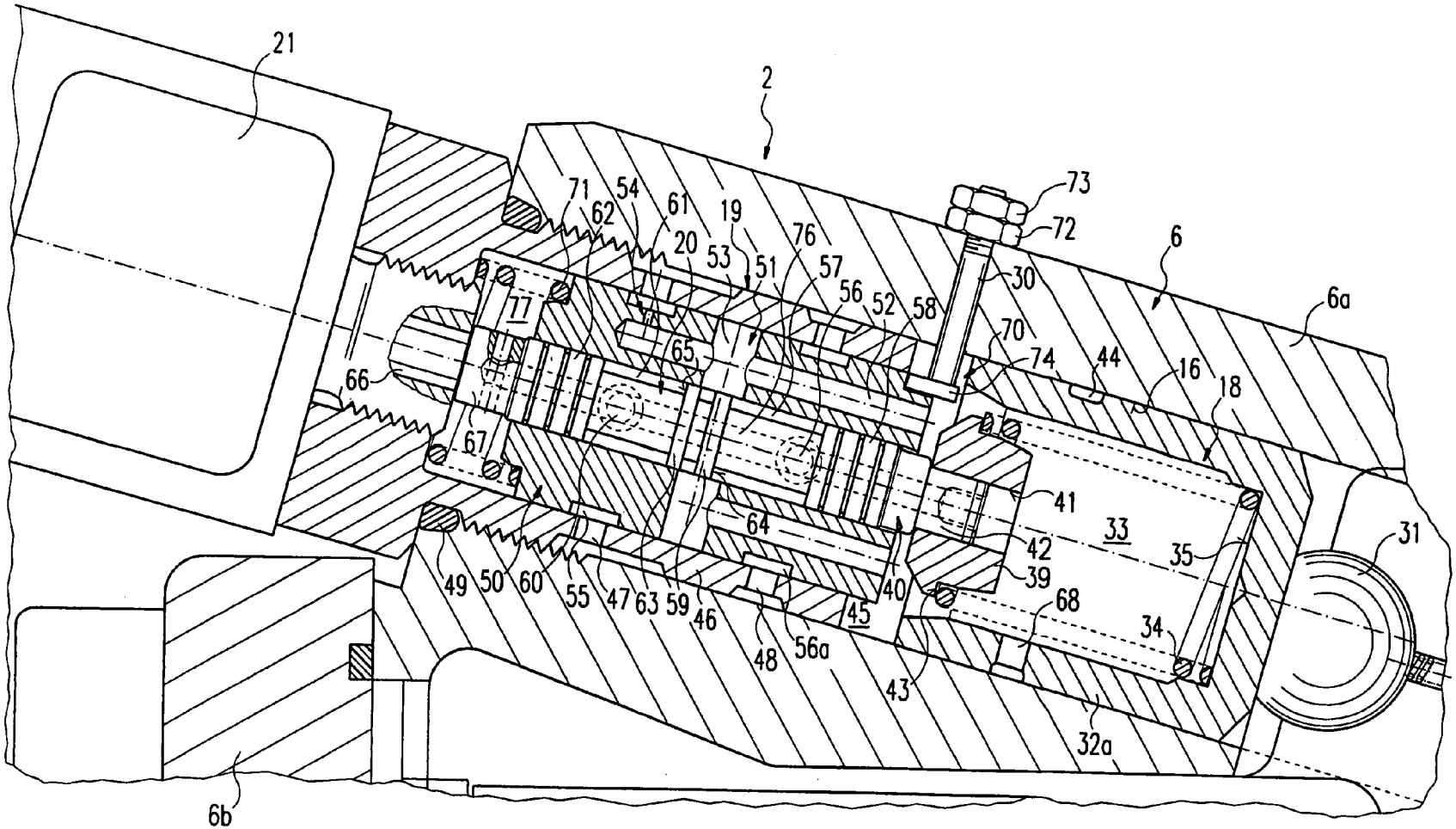
Figure 3:
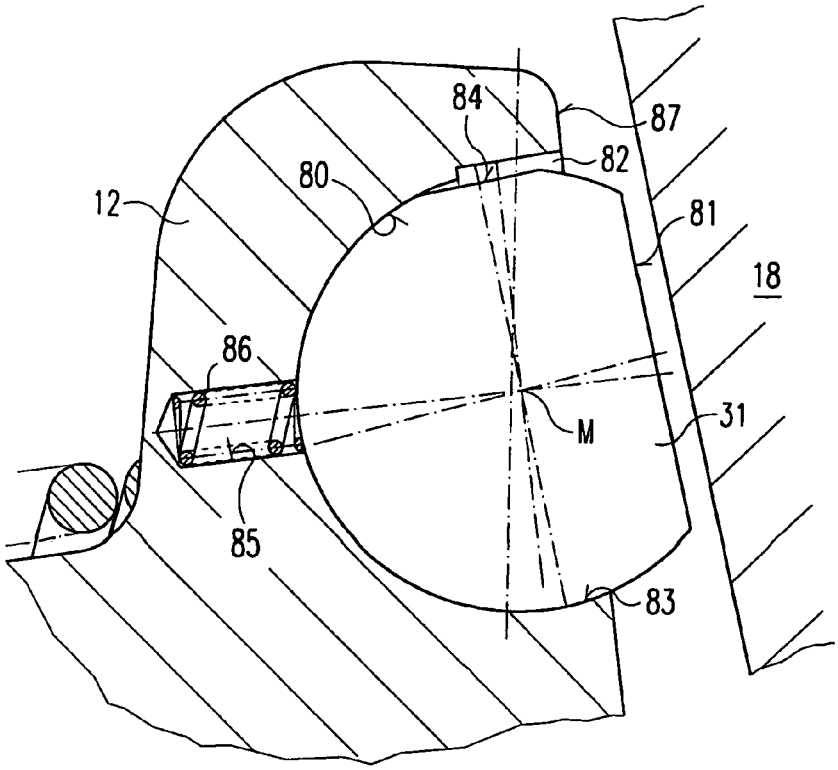
Figure 4:
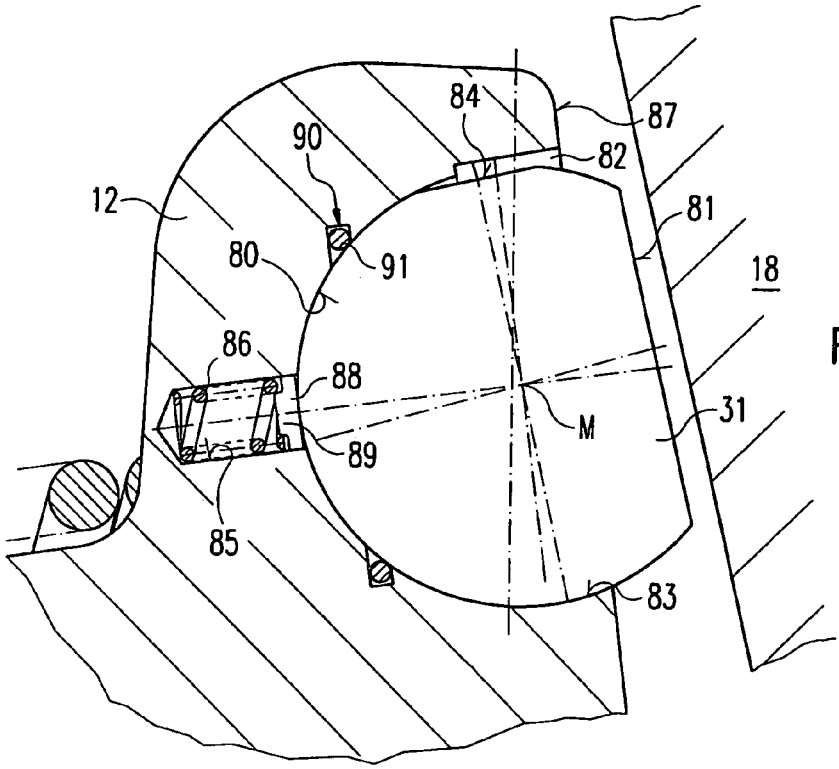
Figure 5:
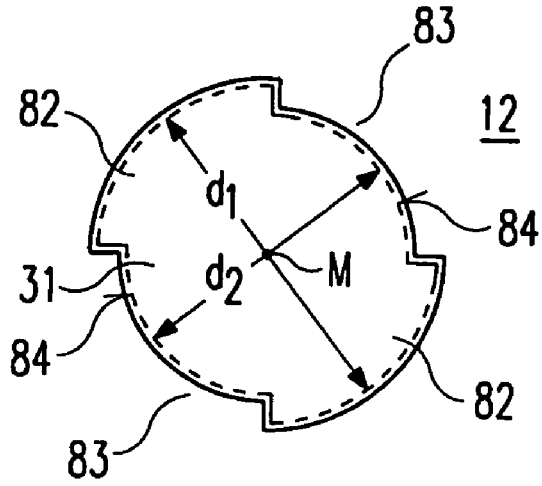
Figure 6:
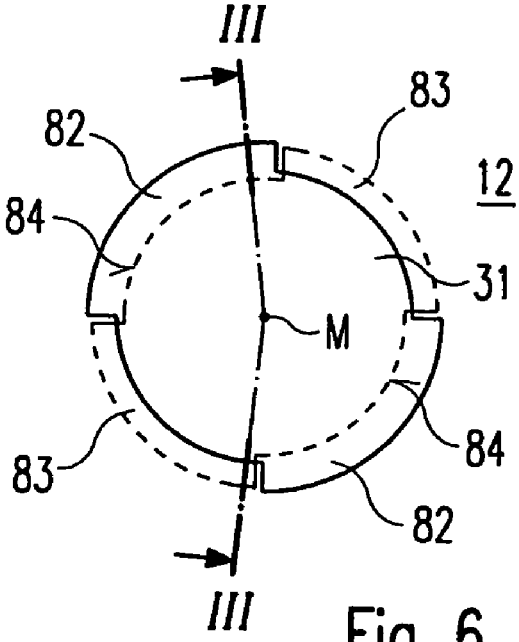

Exemplary embodiments of the inventive axial piston machine having the slide block are illustrated in the drawing and explained in more detail in the description below. The drawing shows:

FIG. 1 a sectional illustration of an axial piston machine according to the invention with a swash plate;

FIG. 2 an enlarged illustration of the adjusting device with the slide block in contact therewith;

FIG. 3 an enlarged illustration of a first exemplary embodiment of a swash plate of an axial piston machine according to the invention;

FIG. 4 an enlarged illustration of a second exemplary embodiment of a swash plate of an axial piston machine according to the invention;

FIG. 5 a schematic illustration of the relative position between the slide block and the swash plate during insertion; and FIG. 6 a schematic illustration of the relative position between the slide block and the swash plate during operation.

FIG. 1 shows an axial section through an axial piston machine 1 in a swash plate design, in which an adjusting device 2 is provided. The basic construction of an axial piston machine 1 in a swash plate design is known, so the description below can be restricted to the essential components.

A shaft 3 is rotatably mounted on a first bearing 4 and on a second bearing 5 in a housing 6 of the axial piston machine 1. The housing 6 of the axial piston machine 1 is divided into a base body 6*a* and a cover body 6*b* which is screwed to the base body 6*a*.

A cylinder drum 7 is connected in torsion-resistant manner to the shaft 3. Located in the cylinder drum 7 are cylindrical bores 8 which are arranged offset on a graduated circle and in which pistons 9 are axially displaceable. The pistons 9 are connected to guide shoes 11 by way of ball-and-socket joints 10 and are supported against a swash plate 12 constructed as a pivot cradle by way of the guide shoe 11. The connection between the cylindrical bores 8 and a high pressure line (not illustrated) and a low pressure line (likewise not illustrated) is effected by way of a control body 13 which has a reniform high pressure opening 14 and a likewise reniform low pressure opening 15. The stroke of the pistons 9 in the cylindrical bores 8 is determined by the pivot angle $\alpha$ of the swash plate 12. In FIG. 1, the swash plate constructed as a pivot cradle is illustrated twice, in its neutral position and in a position which is pivoted through the pivot angle $\alpha$.

The cylinder drum 7 is held in contact with the control body 13 by means of a spring 22. To this end, the spring 22 is supported against the cylinder drum 7 by way of a first ring 23 and against the shaft 3 by way of a second ring 24. The cylinder drum 7 is axially movable with respect to the fixed shaft 3 by way of a keyway connection.

The adjusting device 2 serves to pivot the swash plate 12. The adjusting device 2 is integrated in a receiving bore 16 of the housing 6 and comprises a control piston 18, which is connected to the swash plate 12 by way of the ball-and-socket joint 17 and is axially guided in the receiving bore 16, a control valve 19 which is inserted in the receiving bore 16 and a control element 21 providing a control force for a valve piston 20 of the control valve 19. The ball-and-socket joint 17 comprises a slide block 31 which is inserted in a spherical cutout 80 in the swash plate 12 and is secured there against unintentional rotation by a spring 86. Details of the swash plate 12 and the arrangement of the slide block 31 are explained below in the description relating to FIGS. 3 to 6. The control valve 19 and the control piston 18 are arranged axially offset from one another in the receiving bore 16.

An exemplary embodiment of the adjusting device 2 is illustrated on an enlarged scale in FIG. 2. The exemplary embodiment corresponds substantially to the exemplary embodiment illustrated in FIG. 1, the difference being that an adjusting screw 30 is additionally provided in the exemplary embodiment illustrated in FIG. 2. Moreover, elements which correspond to those in FIG. 1 are provided with corresponding reference numerals to facilitate association.

Abutting in sliding manner against the control piston 18 guided axially in the receiving bore 16 of the housing 6 is the spherical slide block 31 which forms the ball-and-socket joint 17 together with a spherical cutout 80 (illustrated in FIG. 1) of the swash plate 12. The control piston 18 is constructed in a cup shape so that its wall 32 surrounds a cavity 33 which receives a resetting spring 34 for the valve piston 20 of the control valve 19 (which will be described in more detail). The resetting spring 34 is clamped between the base 35 of the cup-shaped control piston 18 and a spring plate 39 which is connected to a first end 40 of the valve piston 20 of the control valve 19. The spring plate 39 has an axial longitudinal bore 41 which is positioned on a pin-shaped projection 42 of the valve piston 20. The resetting spring 35 is supported against an outer step 43 of the spring plate 39. For lubrication of the slide face of the control piston 32, an outer annular groove 44 is provided, which is connected to the cavity 33 by way of a radial channel 68. The annular groove 44 also serves as a hydraulic stop. The diameter of the cavity 33 is dimensioned such that it is greater than the diameter of the spring plate 39, so that the spring plate 39 is received by the cavity 33 of the control piston 18 in the maximum pivotal position (illustrated in FIG. 2).

A control pressure, which is determined by the control element 21 by way of the control valve 19, is established in the control volume 45 surrounding the cavity 33 of the control piston 18. The higher the control pressure in the control volume 44, the further the control piston 18 in FIG. 2 is displaced to the right and pivots the swash plate 12 in the direction of the declining displacement volume of the axial piston machine 1. The smaller the control pressure in the control volume 45, the further the control piston 18 in FIG. 2 pivots to the left in the direction of the rising displacement volume of the axial piston machine 1.

The control valve 19 comprises a fixed sleeve-shaped connecting body 46 in which a tank connection 47 and a pressure connection 48 are constructed. The connecting body 46 is sealed with respect to the housing 6 by way of a seal 49, for example an O-ring. Located within the connecting body 46, there is a valve sleeve 50, in which the valve piston 20 is axially movable. The valve piston 20, the valve sleeve 50, the connecting body 46 and the receiving bore 16 of the housing 6 in which the control valve 19 is inserted are aligned coaxially to one another.

Located in the valve sleeve 50, there is a connecting channel 51, in the exemplary embodiment comprising a longitudinal bore 52 constructed as a blind bore and a transverse bore 53. The connecting channel 51 is connected to the tank connection 47 by way of a throttle 54. In the region of the tank connection 47, the valve sleeve 50 has a first annular channel 55, whilst the valve sleeve 50 has a second annular channel 56 in the region of the pressure connection 48.

The valve piston 20 has a first annular chamber 57 which is connected to the pressure connection 48 by way of a first radial bore 56 and is sealed by way of a sealing portion 58 and a radial projection 59 of the valve piston 20. Furthermore, the valve piston 20 has an annular chamber 61 which is connected to the tank connection 47 by way of a second radial bore 60 and is sealed by way of a sealing portion 62 and a radial projection 63 of the valve piston 20. A first control edge 64 is constructed here at the transition from the first annular chamber 57 to the projection 59, whilst a second control edge 65 is constructed at the transition from the second annular chamber 51 to the projection 63. By way of a plunger 66, the control element 21 exerts a control force on the second end 67 of the valve piston 20, which is opposite the resetting spring 34.

The adjusting device 2 functions in the manner below:

If a hydraulic pressure is applied to the pressure connection 48 and the control element 21 does not exert a control force on the valve piston 20 so that the valve piston 20 is located in its starting position illustrated in FIG. 2, the first control edge 64 opens the connection between the pressure connection 48 and the connecting channel 51. A control pressure therefore builds up in the control volume 45 and displaces the control piston 18 in FIG. 2 to the right in the direction of the minimum displacement volume or the neutral position.

If the control element 21 exerts a control force on the valve piston 20, which displaces the valve piston 20 in FIG. 2 to the right, the first control edge 64 is closed and the second control edge 65 connects the tank connection 47 to the control volume 45 by way of the connecting channel 51. The control volume is therefore relieved of pressure by way of the tank connection 47 and the control pressure decreases. The control piston 18 in FIG. 2 is consequently displaced to the left and the swash plate 12 pivots in the direction of the greater displacement volume of the axial piston machine. At the same time, the resetting spring 34 is prestressed by the movement of the control piston 18 and a counter force opposing the control force of the control element 21 is produced, which increases with the increasing displacement of the control piston 18 in FIG. 2 to the left. If a state of equilibrium is achieved in such a way that the control force exerted by the control element 21 corresponds to the counter force exerted by the resetting spring 34, the valve piston 20 is located in its state of equilibrium so that neither the control edge 64 nor the control edge 65 opens and a constant control pressure is established in the control volume 45. The hydraulic fluid escapes slowly out of the control volume 45 by way of the throttle 54. The escaping hydraulic medium is continuously followed by a slight displacement of the control piston 20 by way of the control edge 64.

If the control force exerted on the control piston 20 is raised or lowered by the control element 21, a new state of equilibrium is established where the respective control force exerted by the control element 21 corresponds to the counter force exerted by the resetting spring 34. The counter force of the resetting spring 34 is proportional to the position of the control piston 18. Each control force produced by the control element 21 therefore corresponds to a defined position of the control piston 18 and therefore to a defined pivot angle $\alpha$ of the swash plate 12.

Located in the valve piston 20 there is, in the exemplary embodiment shown, a through channel 76 which connects the control volume 45 to the spring chamber 77 which receives the pressure spring 71. Thus, in FIG. 2, there is the same pressure to the left of the valve sleeve 50 as to the right of the valve sleeve 50 and the control pressure in the control volume 45 has no influence on the axial position of the valve sleeve 50.

In FIG. 3, the swash plate 12 with the slide block 31 received by it is again illustrated on an enlarged scale. To receive the slide block 31, a spherical cutout 80 is incorporated in the swash plate 12. The diameter of the spherical cutout 80 corresponds to the diameter of the spherical slide block 31.

The invention is not restricted to receiving the slide block 31 in a cutout 80 of the swash plate, as illustrated in the exemplary embodiments. Alternatively, the slide block 31 can also be inserted in the control piston 18. The spherical cutout 80 is then constructed in a manner which corresponds to the cutout of the control piston 18, as described in detail below.

The position of the centre point M of the spherical cutout 80, which coincides with the centre point of the slide block 31, is selected such that the point to which the slide block 31 is received by the cutout 80 is further than its equator. The cutout 80 therefore forms a relief cut which is denoted in general in the drawing as the fixing region 83.

Constructed on the slide block 31, on the side projecting out of the spherical cutout 80, there is a contact face 81 in the form of a planar face by means of which the slide block 31 is supported against the control piston 18. In FIG. 3, the control piston 18 is illustrated at a slight spacing from the slide block 31. As is clearly shown in FIG. 3, the determination of the inclination of the slide block 31 or its contact face 81 relative to the swash plate 12 is offset by the spacing between the contact face 81 and the control piston 18. The slide block 31 can therefore rotate freely in the spherical cutout 80, as a result of which the contact face 81 is inclined with respect to the swash plate 12.

The spherical cutout 80 has over part of the circumference of its opening, at its side 87 facing the adjusting device 2, at least two undercuts 82. Undercuts 82 are formed along the circumference of the opening of the spherical cutout 80, in each case between the fixing regions 83. So that the slide block 31 can be inserted into the spherical cutout 80, flattened portions 84 are constructed on the slide block 31. These flattened portions 84 are arranged distributed over the circumference of the slide block 31 so that the slide block 31 can be inserted into the spherical cutout 80 past the fixing regions 83.

In order to prevent the slide block 31 from sliding out of the spherical cutout 80, the slide block 31 is rotated so that the flattened portions 84 are positioned in the region of the undercuts 82. As a result of the rotation of the slide block 31, those regions of the slide block 31 in which no flattened portions 84 are formed are positioned in the fixing regions 83. The fixing regions 83 surround the slide block 31 and prevent the slide block 31 from slipping out of the spherical cutout 80. The arrangement of the flattened portions 84 on the slide block 31 and the arrangement of the fixing regions 83 and the undercuts on the swash plate 12 are illustrated again below with reference to FIGS. 5 and 6.

The fixing regions 83 surround the slide block 31 and therefore hold it securely in the spherical cutout 80. With this, however, the slide block 31 can still rotate about the centre point M which is common to the spherical cutout 80. In order to increase the force required to rotate the slide block 31, a resilient element is provided in the swash plate 12. According to the preferred exemplary embodiment shown, this resilient element is a spring 86. The spring 86 is inserted into a receiving cutout 85 and, in the unloaded state, is longer than the depth of the receiving cutout 85 constructed, for example, as a blind hole. As a result of inserting the slide block 31 into the spherical cutout 80, the spring 86 is compressed and is supported against the base of the blind hole. The spring 86 therefore exerts a force on the slide block 31 at all times, and this force presses the slide block 31 in the direction out of the spherical cutout 80.

The slide block 31 is prevented from sliding out as a result of this force by the fixing regions 83 against which the slide block abuts with part of its surface in the manner described above. At the fixing regions 83, the force generated by the spring 86 is supported by the fixing regions 83. As a result of the slide block 31 supporting this spring force at the fixing regions 83, a friction force is generated between the slide block 31 and the fixing regions 83.

The extent of this friction force depends on the prestress of the spring 86 and can be freely selected by choosing an appropriate spring 86. The spring 86 can therefore be selected so that unintentional rotation of the slide block 31 is reliably prevented. When choosing the spring 86, it should likewise preferably be taken into account that the receiving bore 85 is in any case already incorporated in the swash plate 12. The receiving cutout 85 is used to guide a tool during the production of the spherical cutout 80. It is thus possible to fix the position of the slide block 31 by simple means without an additional operating step.

FIG. 4 shows a slight modification which prevents mechanical damage to the surface of the slide block 31 by altering the angle between the swash plate 12 and the slide block 31 during operation of the piston machine. The spring 86 does not act directly on the surface of the slide block 31 but transmits its force to a spacer 88 which is in turn supported on the slide block 31. To facilitate assembly, the spring 86 can be selected here so that it is short enough for the spacer 88 to be guided a short distance through the receiving cutout 85. It is alternatively possible to construct an extension 89 on the spacer 88, the outer diameter of which corresponds to the inner diameter of the spring 86 constructed as a helical spring. This extension 89 can then be inserted into the spring 86, thereby eliminating the risk of faulty positioning during assembly of the slide block 31.

Instead of the spring 86, it is also possible to use another resilient element, for example a rubber cylinder, which is resiliently deformable. Such a resilient element in the form of a rubber cylinder can likewise be inserted into the receiving cutout 85. When selecting the material, it is necessary to ensure that the pressure medium used in the piston machine, which is also used to lubricate the slide block 31 in the spherical cutout 80, does not attack the resilient material.

A further alternative consists in constructing a circumferential groove 90 in the spherical cutout 80, in which a spring washer 91 is inserted. The advantage of such a spring washer 91 over the spring 86 used in the receiving cutout 85 is that a single positioning of this resilient element through insertion into the groove 90 also ensures that it remains in this position whilst the slide block 31 is inserted into the spherical cutout 80. A spring washer 91 is prestressed in the radial direction as a result of the insertion of the slide block 31 and thus likewise acts on the slide block 31 with a force which generates a friction force on the fixing regions 83.

FIG. 5 shows a plan view of the swash plate 12 from the side 87 facing the control device 2 during the assembly of the slide block 31. In FIG. 5, the continuous line shows the edge of the opening of the spherical cutout 80 from the side 87 facing the adjusting device 2. In the region of the undercuts 82, the expansion of the opening is greater than the diameter $d_1$ of the spherical slide block 31. Here, the undercuts 82 each extend along a quadrant. The fixing regions 83 likewise extend along a quadrant, albeit in an arrangement rotated through 90° with respect to the undercuts 82. Instead of arranging the undercuts 82 and the fixing regions 83 in pairs as shown, it is also possible to select other geometries.

Constructed on the slide block 31 are flattened portions 84 which preferably extend along a circle line which is concentric with the centre point M of the spherical slide block 31. The diameter $d_2$ of this circle line is somewhat smaller than the expansion of the opening of the spherical cutout 80 in the fixing regions 83.

The slide block 31 can therefore be inserted into the spherical cutout 80 in the plane of the drawing, in the position shown in FIG. 5. The slide block 31 is then rotated through 90° and the slide block 31 is thus fixed in the swash plate 31 in the manner of a bayonet closure. This gives the arrangement shown in FIG. 6.

The slide block 31 is now covered by the fixing regions 83 in the region of its full diameter $d_1$ whilst the flattened portions 84 are arranged opposite the undercuts 82. The spherical slide block 31 is held in the spherical cutout 80 as a result of part of the slide block 31 and the fixing regions 83 constructed on the swash plate 12 covering one another.

The position of the section shown in FIGS. 3 and 4 is furthermore indicated in FIG. 6. Owing to the selected position of the section of the swash plate 12, it is possible to see both an undercut 82 and a fixing region 83 in FIGS. 3 and 4.

The invention is not restricted to the exemplary embodiments shown, but also includes possible combinations of features of the individual exemplary embodiments.

The invention claimed is:

1. An axial piston machine having a swash plate and a control piston which contacts the swash plate by way of a slide block which is partially received by the swash plate or the control piston and can be inclined at least in a direction relative to the swash plate or the control piston and which can be inserted through an opening into a cutout constructed in the swash plate or the control piston, the slide block being fixed in the cutout by fixing regions constructed in the cutout, wherein provided in the swash plate or the control piston, there is a resilient element which acts on the slide block with a force directed towards the regions fixing the slide block.

2. An axial piston machine according to claim 1, wherein the resilient element is inserted into a receiving cutout arranged on the side opposite the opening.

3. An axial piston machine according to claim 1, wherein the resilient element is a pressure spring.

4. An axial piston machine according to claim 1, wherein the resilient element is a spring washer.

5. An axial piston machine according to claim 1, wherein a spacer is arranged between the resilient element and the slide block.

6. An axial piston machine according to claim 1, wherein the slide block and the cutout have a spherical geometry with a common center point (M) and the cutout forms a relief cut in the swash plate or the control piston.

7. An axial piston machine according to claim 6, wherein the fixing regions are formed by the relief cut of the cutout.

* * * * *